United States Patent [19]

Lee

[11] Patent Number: 4,867,730

[45] Date of Patent: Sep. 19, 1989

[54] MOTOR ACTUATING MECHANISM FOR ANIMATED FIGURES

[76] Inventor: Yeong-ruey Lee, P.O. Box 10780, Taipej 10099, Taiwan

[21] Appl. No.: 66,349

[22] Filed: Jun. 25, 1987

[51] Int. Cl.[4] ..... A63H 13/02

[52] U.S. Cl. ..... 446/353; 446/352; 446/354; 446/330

[58] Field of Search ..... 446/330, 331, 333, 334, 446/335, 352, 353, 354, 370, 371; 40/414

[56] References Cited

U.S. PATENT DOCUMENTS

| | | | |
|---|---|---|---|
| 637,508 | 11/1899 | Grimoin-Sanson et al. | 446/330 X |
| 1,586,444 | 5/1926 | Griewank | 446/330 X |
| 1,784,183 | 12/1930 | Fike | 446/333 |
| 1,991,011 | 2/1935 | Carniol | 446/333 X |
| 2,290,801 | 7/1942 | Dale et al. | 446/333 X |
| 2,727,334 | 12/1955 | Ostrander | 446/330 |
| 2,899,774 | 8/1959 | Mandel | 446/335 |

FOREIGN PATENT DOCUMENTS

| | | | |
|---|---|---|---|
| 508298 | 1/1920 | France | 446/330 |
| 1265903 | 5/1961 | France | 446/354 |
| 468818 | 7/1937 | United Kingdom | 446/352 |
| 2188851 | 10/1987 | United Kingdom | 446/353 |

*Primary Examiner*—Robert A. Hafer
*Assistant Examiner*—Sam Rimell
*Attorney, Agent, or Firm*—Browdy and Neimark

[57] ABSTRACT

A motor actuating mechanism for animated figures has an eccentric pin member which rotates around a rotatable shaft fixing on the interior of a frame. While the motor is driving, the eccentric pin member will activate the first link member positioned on the frame to move the figure's head. Furthermore, the first link member will activate the second link member and the L-shaped third link member to swing and make the figure's hand-/tail move, and also, the eccentric pin member will also activate several connected draw link member to cause the figure's foot to move.

5 Claims, 6 Drawing Sheets

MOTOR ACTUATING MECHANISM FOR ANIMATED FIGURES

BACKGROUND OF THE INVENTION

This invention is a kind of a simple drive mechanism which imitates animal's motion. Some traditional devices that make figure's limb move have been granted a U.S. Pat. Nos. 4,407,090; 3,995,394; 4,003,158; 4,422,261; and 4,085,540. In addition, a U.S. Pat. No. 4,231,184 relates to an invention which makes the figure's arms move by means of a driven motor. These devices mostly have applied the driven gears to activate arms. Their structure is rather complicated and their design can not simultaneously activate the arms and swing the head.

SUMMARY OF THE INVENTION

In order to improve the traditional figure's motion, the invention provides a simpler actuating mechanism that makes the figure produce various motion styles and the entertainment of playing with the figures is thereby increased.

The major purpose of the invention is to provide a figure for making the swinging, lifting and lowering movements of the figure's head.

The second purpose of the invention is to provide a figure for making the swinging movements of the figure's hand or foreleg.

The third purpose of the invention is to produce a figure for making the swinging movements of the figure's tail.

Another purpose of the invention is to provide a figure for making the regular movements of the figure's foot such as tapping beats in music.

An additional purpose of the invention is to provide a figure for making the movements of the figure's head, hand, foot, tail of other similar limbs simultaneously.

A further purpose of the invention is to provide a very simple actuating mechanism for imitating man's or animal's movements.

DETAILED DESCRIPTION OF THE INVENTION

Figure 1:
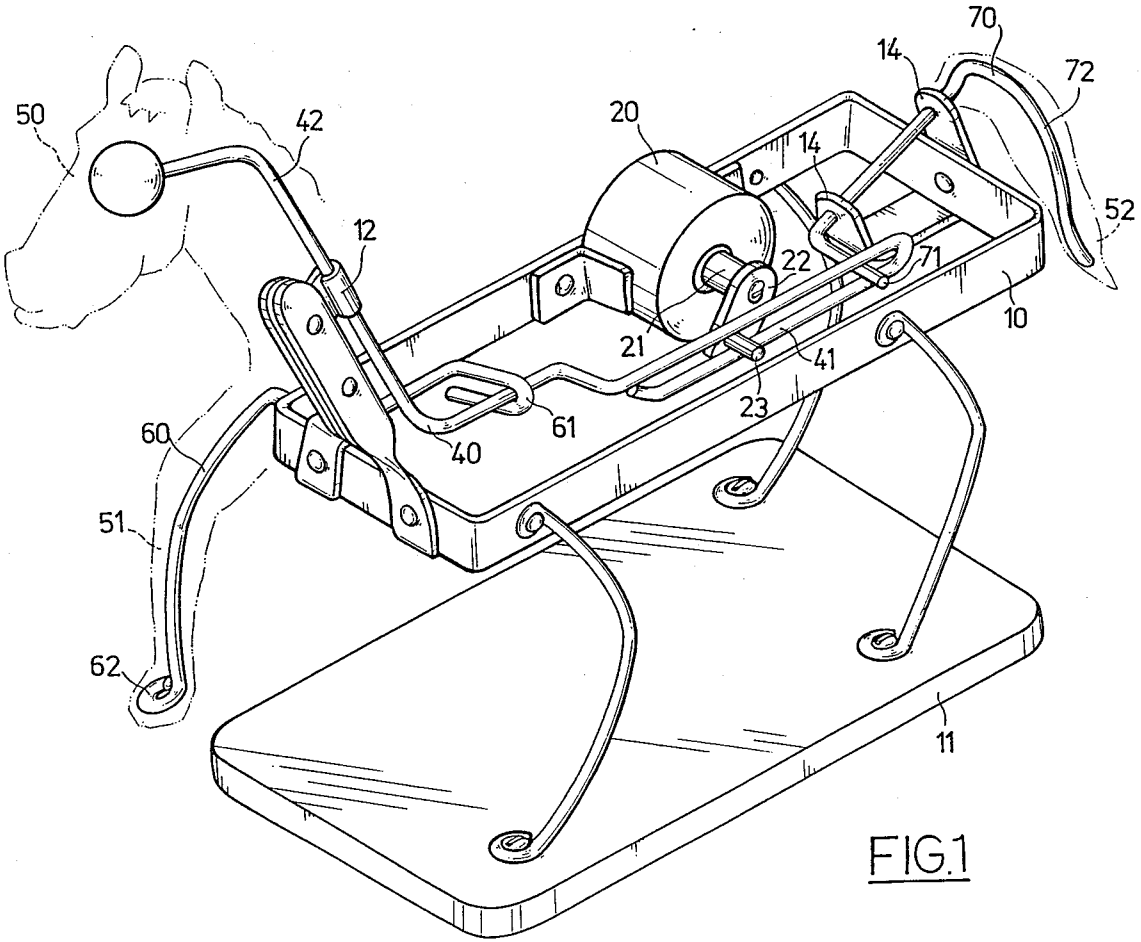
FIG. 1 is a perspective view of the invention.

As shown in the drawings, the device of this invention comprises a frame 10 to support the body of a figure and to be fixed on a base 11. A motor 20 is fixed on the interior of the frame 10. The rotatable motor shaft 21 which is usually maintained in a horizontal position has one end connected with an eccentric pin member 23 which runs parallel to rotatable shaft 21, the typical design being that the first end of a rotary member 22 is shaft 21, the typical design being that the first end of a rotary member 22 being fixed on the rotatable shaft 21 and the second end is connected vertically with the pin member 23. The slotted follower 41 on the lower end of the first link member 40 receives the eccentric shaft pin member 23. The upper portion of the link member 40 is fixed by a swing member 12 and one end of the swing member 12 is pivotally mounted on the front end of the frame 10.

Figure 2:
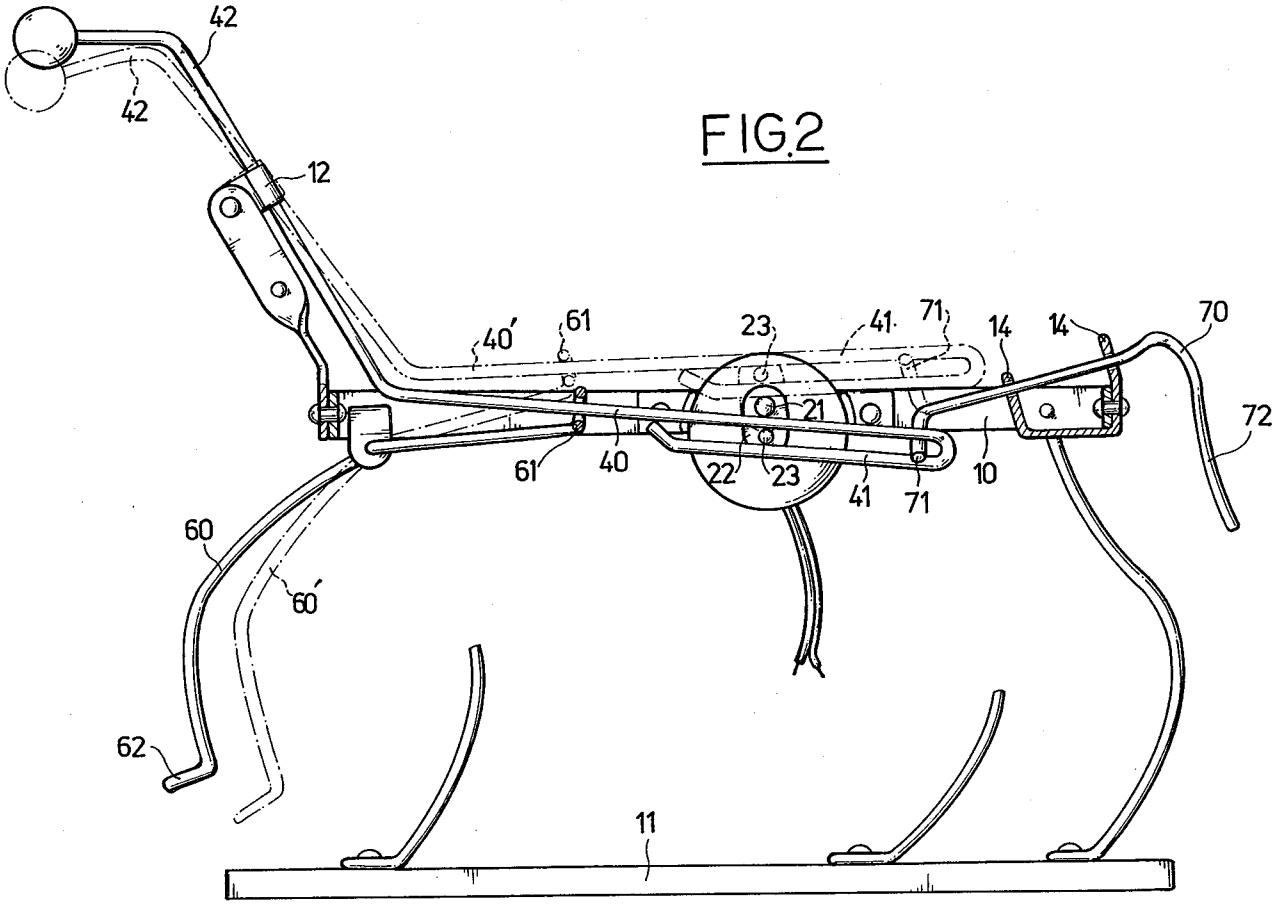
FIG. 2 is a front view of the invention.
Figure 6:
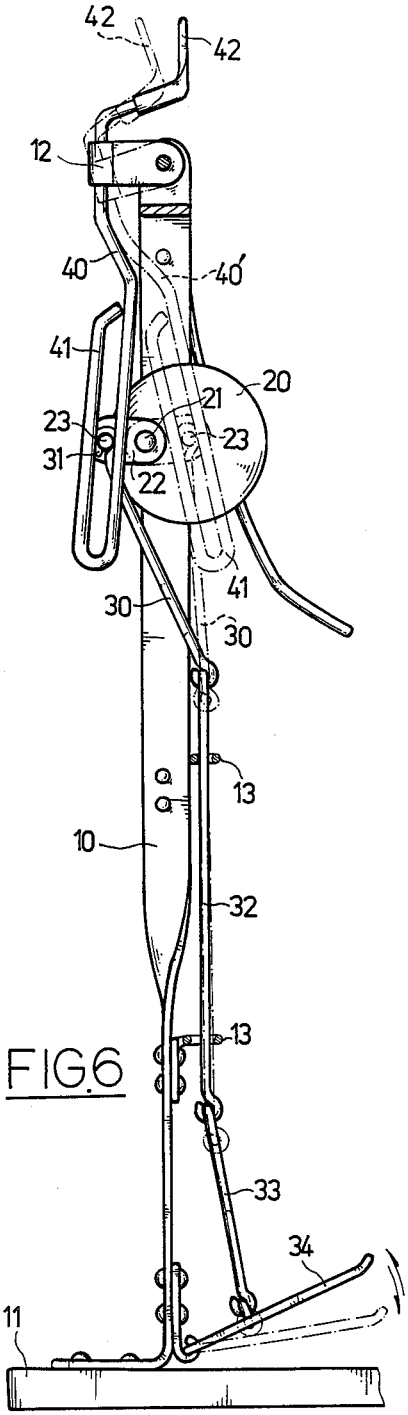
FIG. 6 is a side view of the second example of the invention.

The first end 42 of the first link member 40 juts out from the frame 10. As shown in FIGS. 2 and 6, when the rotatable shaft 21 turns and causess the rotary member 22 to rotate, the eccentric pin member 23 can activate the link member 40 to swing to the 40' position as the imaginary line shows. There is a figure's head 50 attached on the first end 42 of the link member 40. With the pivotally mounted swing member 12 which is activated by the first link member 40, the head 50 thereby makes amusing lifting and lowering movements.

Figure 8:
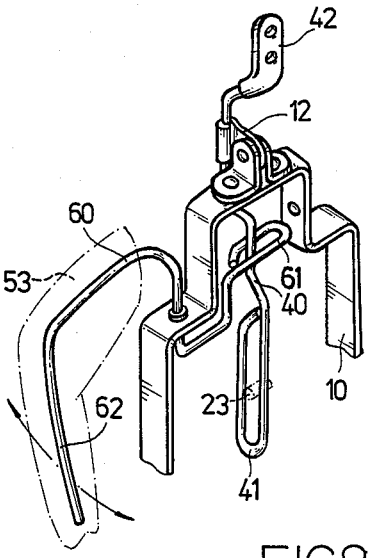
FIG. 8 is a partial perspective view of the third example of the invention.

As FIG. 2 shows, a second slotted follower 61 i.e. the second end of the second link member 60, is connected to the middle portion of the first link member 40. The middle portion of the second link member 60 is pivoted at the front portion of the frame 10 and the first end 62 of the second link member 60 stands outside of the frame 10. While the swing motion of the first link member 40 is made, the middle portion of the first member 40 will carry the second link member 60 to move to the 60' position. Therefore, a foreleg of an animal figure as shown in FIG. 1 or a hand of a human figure in FIG. 8 which is attached to the first end 62 of the second link member 60 will also be activated to generate amusing movements.

Figure 3:
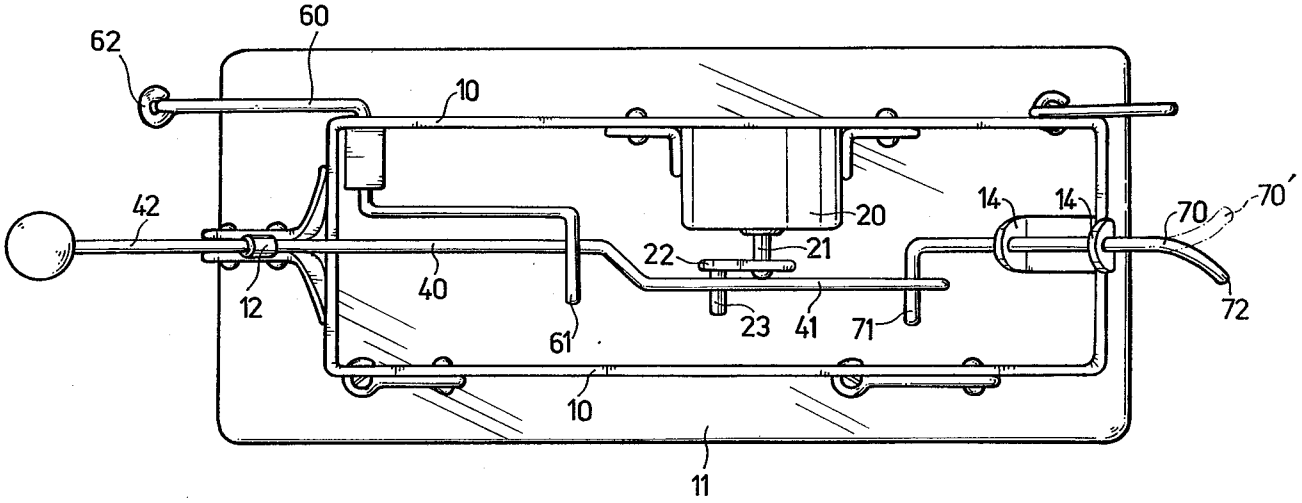
FIG. 3 is a top view of the invention.

Referring to FIGS. 1, 2, and 3, at the rear part of the frame 10, a stationary plate 14 holds an L-shaped third link member 70. The first end 71 of the third link member 70 inserts into the slotted follower 41 of the first link member 40 and the outstanding second end 72 is attached with an animal's tail 52. When the first link member 40 is driven up and down by the motor 20, the third link member 70 which is at the rear part of the frame 10 will swing left and right, shown in FIG. 3 as the 70' position, which looks like the animal tail is waving and thus, causing vivid and interesting motions.

Figure 7:
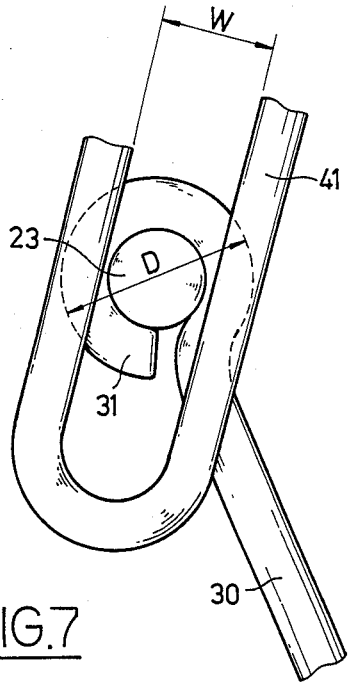
FIG. 7 is a greatly enlarged detailed side view of the invention which showing the structure of the slotted follower, the hook and the pin member.
Figure 4:
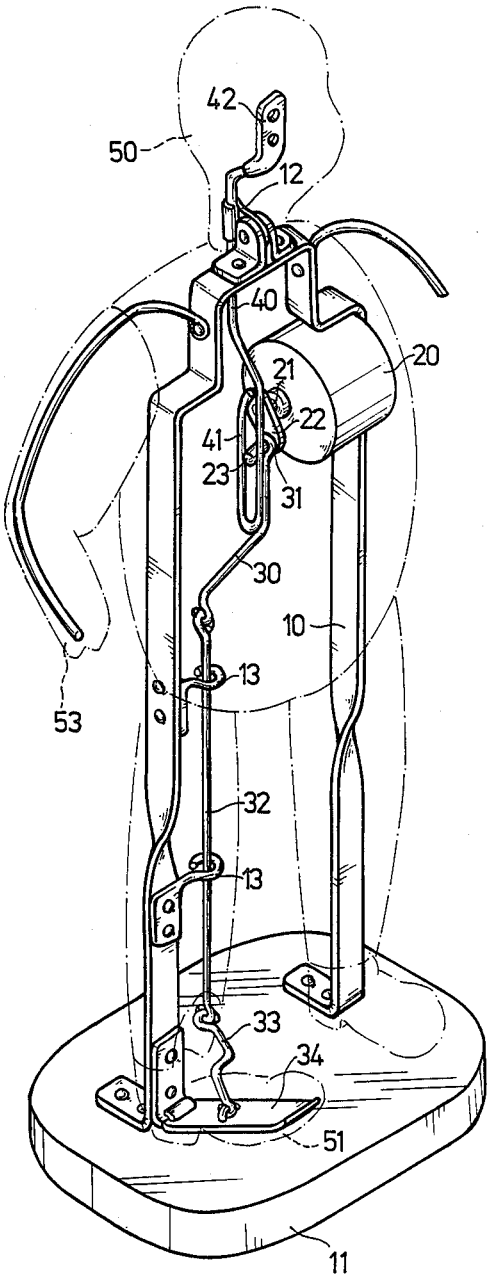
FIG. 4 is a perspective view of the second example of the invention.
Figure 5:
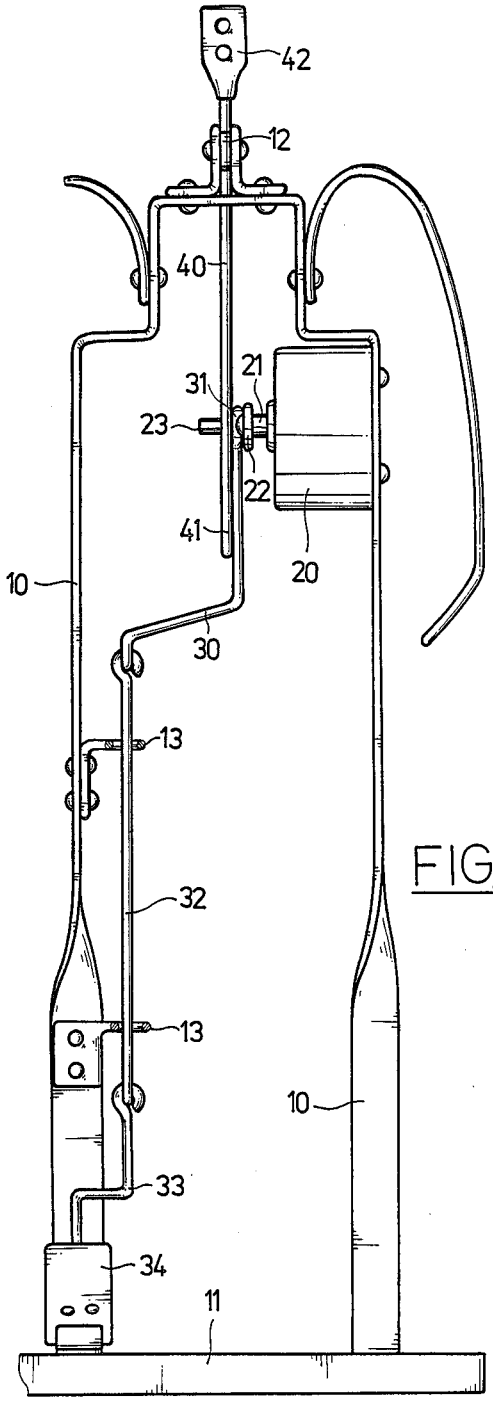
FIG. 5 is a front view of the second example of the invention.

With the application of the foregoing mechanism i.e. the eccentric pin member 23 rotating around the rotatable shaft 21 of the motor 20, the figure's hand/foreleg or the other similar limbs will do reciprocating motions. A preferred embodiment is illustrated in FIGS. 4, 5 and 6, in which a first end of a first draw link member 30 is first hooked on the eccentric pin member 23 and then the pin member 23 is inserted into the slotted follower 41 which is at the second end of the first link member 40. The upper portion of the first link member 40 is held by the rounded end of a swing member 12. The other end of the swing member 12 is fixed on the top portion of the frame 10. Referring now to FIG. 4, the first draw link member 30 is well-kept and is just pivotally hooked on the pin member 23, without the necessity of any fixing member, because of the rigidity of the slotted follower 41 of the first link member 40 which stops the first draw link member 30 being off from the pin member 23. The main elements of above-mentioned mechanism is shown as FIG. 7: (1) The internal diameter W of the slotted follower 41 should be less than the external diameter D of the hook 31 which is the first end of the first draw link member 30. (2). The hook 31 hooked pivotally on the eccentric pin member 23 is kept between the slotted follower 41 of the first link member 40 and the rotary member 22 of the rotatable shaft 21.

As FIG. 4 shows, the second end of the first draw link member 30 is connected with the first end of a slide link member 32; the second end of the slide link member 32 is jointed with the first end of a second draw link member 33; the second end of the second draw link member 33 is fixed on the middle portion of a swing plate 34, and the second end of swing plate 34 is pivotally mounted on the bottom of the frame 10. The slide link member 32 is kept by a pair of rail members 13 which forms a rail path for the slide link member 32 to slide up and down. When the first draw link member 30 is driven by the rotatable shaft 21, the draw link member 30 functions in a crank motion and activates the slide link member 32 and the second draw link member 33. The swing plate 34 on the human figure's foot 51 is attached and will also be activated accordingly to move up and down generating an effect which looks like a singer taping his foot 51 with the beats. With an additional mechanism connected to the swing plate 34, which functions as a pedal mechanism of the jazz percussion instruments, it may have an exaggerated effect of the figure's movement of being rhyming with the beats, and the amusement of playing the figure is therefore greatly increased.

In conclusion, the above-mentioned first link member 40, second link member 60, third link member 70 and the first draw link member 30 may optionally or simultaneously be set on the frame 10. When the motor 20 drives the eccentric pin member 23 to rotate, it can activate the first link member 40 to produce forward-backward swing and lifting-lowering movements and cause the figure's head to move the same; also, it can activate the second link member to which is connected with the first link member 40 to swing and cause figure's hand/foreleg to move; and it can activate the L-shaped third link member 70 which is connected with the slotted follower 41 of the first link member 40 to swing left and right and cause the figure's tail 52 to move the same. In other embodiment, likewise, it can activate a draw link member 30 by crank motion to cause the doll's foot, by applying a very simple mechanism like the present invention, the object of moving the figure's head, hand, foot or tail is achieved.

Figure 9:
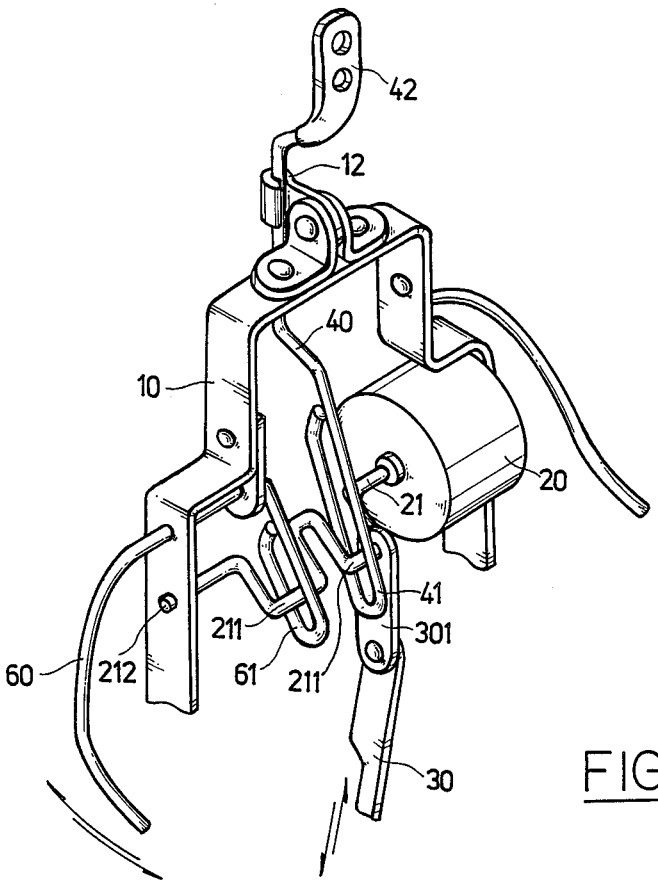
FIG. 9 is a partial perspective view of another example of the invention.

Another activating method, other than using the rotatable shaft 21 to cause the eccentric pin member 23 to be rotate around the rotatable shaft 21, is illustrated in FIG. 9, in which the rotatable shaft 21, is directly made bent to be a crank, and an eccentric portion 211 is formed thereby, which is not on but parallel to the axis of the motor 20, for functioning the same as an eccentric pin member. In order to prevent the crank-shaped rotatable shaft 21 from deforming, it is preferably to fix the free end 212 of the rotatable shaft 21 onto the frame 10 or other appropriate supporters.

Furthermore, another embodiment of the followers, which are activated by the pin member 23 or the eccentric portion 211, other than above-mentioned slotted followers 41 and 61 or the hook 31, is also illustrated in FIG. 9. By applying a rotatable plate 301 with the first end pivotally mounted on the eccentric portion 211 and the second end pivotally mounted with other followers, such as a draw link member 30, the activating motion can be functioned the same.

I claim:

1. A motor actuating mechanism for animated figures comprising:

a base;

a frame, fixed upon said base, for supporting a torso of the figure;

a swing member pivotally mounted upon said frame;

a fist link member having a first end and a second end, fixed on said swing member, said first end of said first link member being adapted to receive a head of the figure thereon, and said first link member having a slotted follower;

an activating means, fixed on an interior of said frame, including:

a motor having a rotatable shaft which has a substantially horizontal axis of rotation;

a rotary member having a first and a second end, said first end of said rotary member fixedly connected to the rotatable shaft of said motor for rotating therewith; and a pin member, fixed to said second end of said rotary member, extending substantially parallel to said rotatable shaft axis, inserted into said slotted follower of said first link member.

2. A motor actuating mechanism of claim 1, further comprising:

a second link member having a first and a second end, pivotally mounted on said frame, said first end of said second link member being adapted to receive a limb of the figure thereon, and said second end of said second link member having a slotted follower formed as a slot slidingly receiving said first link member.

3. A motor actuating mechanism of claim 1, further comprising:

a L-shaped third link member having a first and a second end, pivotally mounted on said frame, said first end of said third link member inserted into said slotted follower of said first link member, and said second end of said third link member being adapted to receive a tail of the figure thereon.

4. A motor actuating mechanism of claim 1, further comprising:

a first draw link member having a first end and a second end, said first end of said first draw link member having a hook pivotally mounted on said pin member;

a slide link member having a first and a second end, said first end of said slide link member pivotally mounted with said second end of said first draw link member;

a rail member fixed on said frame, having a rail slidingly receiving said slide link member;

a swing plate having a first and a second end, said first end of said swing plate being adapted to receive a foot of the figure thereon, and said second end of said swing plate pivotally mounted on said frame;

a second draw link member having a first and a second end, said first end of said second draw link member being pivotally mounted with said second end of said slide link member, and said second end of said second draw link member being pivotally mounted on said swing plate at the portion between said first end and said second end of said swing plate.

5. A motor actuating mechanism of claim 4, wherein said hook of said first draw link member pivotally mounted between said slotted follower of said first link member and said rotary member, and the external diameter of said hook of said first draw link member is greater than the internal diameter of said slotted follower of said first link member.

* * * * *